US011384602B2

(12) United States Patent
Lacroix

(10) Patent No.: US 11,384,602 B2
(45) Date of Patent: Jul. 12, 2022

(54) BORING ASSEMBLY AND ASSOCIATED BORING METHOD

(71) Applicant: FRAMATOME, Courbevoie (FR)

(72) Inventor: Marc Lacroix, Lyons (FR)

(73) Assignee: FRAMATOME, Courbevoie (FR)

( * ) Notice: Subject to any disclaimer, the term of this patent is extended or adjusted under 35 U.S.C. 154(b) by 0 days.

(21) Appl. No.: 16/960,038

(22) PCT Filed: Jan. 4, 2019

(86) PCT No.: PCT/EP2019/050139
§ 371 (c)(1),
(2) Date: Jul. 3, 2020

(87) PCT Pub. No.: WO2019/134956
PCT Pub. Date: Jul. 11, 2019

(65) Prior Publication Data

US 2020/0347679 A1 Nov. 5, 2020

(30) Foreign Application Priority Data

Jan. 5, 2018 (FR) ..... 1850103

(51) Int. Cl.
*E21B 7/18* (2006.01)
*E21B 7/16* (2006.01)
(Continued)

(52) U.S. Cl.
CPC ..... *E21B 7/18* (2013.01); *E21B 7/16* (2013.01); *E21B 7/24* (2013.01); *E21B 21/065* (2013.01)

(58) Field of Classification Search
CPC ..... E21B 7/18; E21B 7/16; E21B 7/24; E21B 7/00; E21B 21/065; E21B 10/18; E21B 43/29; E21C 45/04; E21C 25/69
See application file for complete search history.

(56) References Cited

U.S. PATENT DOCUMENTS 2,698,736 A * 1/1955 Ledgerwood, Jr. ..... E21B 7/16 175/54
2,868,509 A * 1/1959 Philips ..... E21B 7/16 175/54

(Continued)

FOREIGN PATENT DOCUMENTS

| | | | |
|---|---|---|---|
| EP | 0481545 | A1 | 4/1992 |
| JP | S642899 | A | 1/1989 |
| WO | WO2018/121815 | A1 | 7/2018 |

OTHER PUBLICATIONS

Corresponding Search Report PCT/EP2019/050139.

*Primary Examiner* — Yong-Suk (Philip) Ro
(74) *Attorney, Agent, or Firm* — Davison, Davidson & Kappel, LLC

(57) ABSTRACT

A boring assembly extends along a main axis and comprises a boring head comprising at least one first nozzle and at least one second nozzle The or each second nozzle is different from the or each first nozzle. The boring assembly includes a first delivery device configured to deliver a jet of abrasive-free water at a pressure comprised between 2000 bar and 4000 bar to the at least one first nozzle. The boring assembly includes a second delivery device configured to deliver a jet containing at least one abrasive material at a pressure comprised between 2000 bar and 6000 bar to the at least one second nozzle.

17 Claims, 3 Drawing Sheets

(51) Int. Cl.
*E21B 7/24* (2006.01)
*E21B 21/06* (2006.01)

(56) References Cited

U.S. PATENT DOCUMENTS

| | | | | | |
|---|---|---|---|---|---|
| 3,897,836 | A | * | 8/1975 | Hall | E21B 21/14 175/93 |
| 4,708,214 | A | * | 11/1987 | Krawza | B24C 1/045 175/424 |
| 4,850,440 | A | | 7/1989 | Smet | |
| 2012/0067184 | A1 | | 3/2012 | Hach | |
| 2019/0141434 | A1 | | 5/2019 | Fukuma | |

* cited by examiner

BORING ASSEMBLY AND ASSOCIATED BORING METHOD

The present invention relates to a boring assembly extending along a central axis. The invention also relates to a boring method.

In particular, the invention relates to boring in a civil engineering structure, in particular during the dismantlement of nuclear power plants.

BACKGROUND

The boring technique by hollow core drilling is known using a boring crown with the same diameter as the hole to be made in the structure.

However, this technique does not make it possible to produce inclined boreholes in a satisfactory manner. Indeed, at the end of boring, part of the boring crown still pierces the structure, while the rest of the crown protrudes outside the structure and can damage an equipment item located near the structure.

Also known from US20120067184 is a boring system for performing the hydrodemolition of concrete. The system comprises a boring head configured to supply a high-pressure jet of water and another boring head configured to supply an abrasive jet.

However, the handling of such a system is complicated.

SUMMARY

The aim of the present disclosure is then to propose a boring system making it possible to simplify handling thereof.

To that end, a boring assembly of the aforementioned type is provided, comprising:

- a boring head including:
  - at least one first nozzle;
  - at least one second nozzle, the or each second nozzle being different from the or each first nozzle;
- a first delivery device configured to deliver a jet of abrasive-free water at a pressure of between 2000 bar and 4000 bar to the at least one first nozzle;
- a second delivery device configured to deliver a jet containing at least one abrasive material at a pressure of between 2000 bar and 6000 bar to the at least one second nozzle.

The handling of the boring assembly according to the present disclosure is simpler. Indeed, the boring using the boring assembly according the present disclosure does not require the alternating introduction of several boring heads, as is the case for the boring systems of the state of the art, which causes lost time and boring imprecisions.

According to other advantageous aspects of the present disclosure, the boring assembly comprises one or more of the following features, considered alone or according to any technical possible combinations:

- the boring head is cylindrical, and has a central head axis extending along the main axis;
- the boring head has a diameter of between 200 mm and 1000 mm;
- the boring assembly comprises a frame and a first rotational drive of the boring head relative to the frame around the central head axis;
- the boring assembly comprises a body, a first cylindrical support having a first support central axis different from the central head axis and a second rotational drive of the first support relative to the body around the first support central axis, the at least one second nozzle being arranged on the first support, and the first support being connected to the body in rotation around the first support central axis;
- the boring assembly comprises a second cylindrical support having a second support central axis different from the first support central axis, a third rotational drive of the second support relative to the first support around the second support central axis, the at least one first nozzle being arranged on the second support, and the second support being connected to the first support in rotation around the second support central axis;
- the at least one second nozzle is configured to deliver an adjustable jet forming an angle between 0° and 45° relative to an axis passing through the second nozzle and parallel to the main axis;
- the boring assembly comprises a rubble suction port, preferably arranged in the body and extending along the main axis;
- the boring head comprises a lighting device and a camera, preferably supported by the first support;
- the boring assembly comprises a fourth drive of the boring head in translation along the main axis relative to the frame;
- the boring head has a front face substantially orthogonal to the main axis, the first nozzle and the second nozzle emerging on the front face.

The present disclosure also relates to a boring method using a boring assembly as described above, comprising the following steps:

- first delivery by the first delivery device of a jet of abrasive-free water at a pressure of between 2000 bar and 4000 bar to the at least one first nozzle;
- second delivery by the second delivery device of a jet containing at least one abrasive material at a pressure of between 2000 bar and 6000 bar to the at least one second nozzle; the first delivery having taken place before, during and/or after the second delivery.

According to another advantageous aspect of the present disclosure, the boring method comprises the following steps:

- demolition of the concrete body by the jet of abrasive-free water delivered during the first delivery,
- cutting of a metal element by the jet including at least one abrasive material delivered during the second delivery.

BRIEF DESCRIPTION OF THE DRAWINGS

Other features and advantages of the present disclosure will emerge from the following detailed description, provided for information and non-limitingly, in reference to the appended figures, in which.

DETAILED DESCRIPTION

Figure 1:
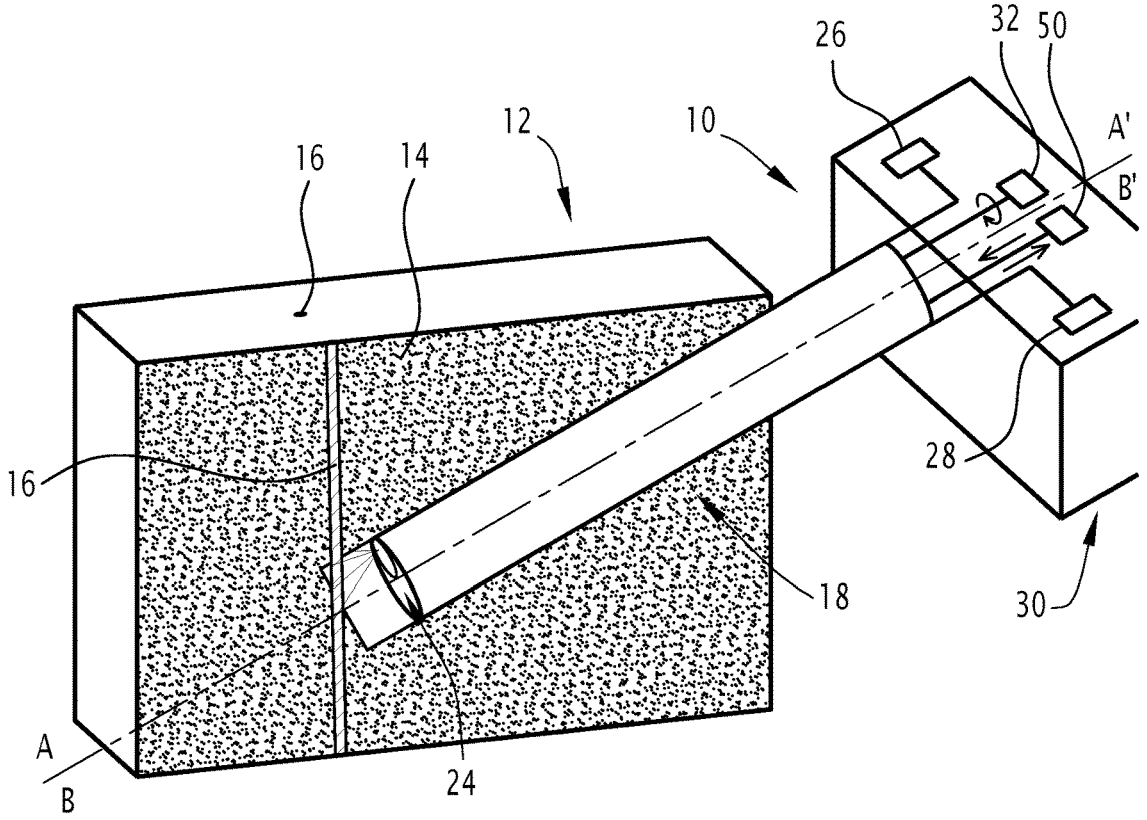
FIG. 1 is a schematic, partially sectional illustration of a boring assembly according to the present disclosure and a sectional view of a wall in which the boring assembly is introduced.

A boring assembly 10 is shown in FIG. 1.

The boring assembly 10 is configured to bore a wall 12, in particular a wall 12 including mineral and metallic elements. In particular, the wall 12 is made from reinforced concrete made up of concrete 14 and metallic elements 16. The metallic elements 16 are for example bars of iron or steel.

The boring assembly 10 extends along a main axis A-A'.

The boring assembly 10 comprises a boring head 18 including at least one first nozzle 20 and at least one second nozzle 22, the or each second nozzle 22 being different from the or each first nozzle 20.

As shown in FIG. 1, the boring assembly 10 comprises, in the example illustrated in the figures, a single first nozzle 20 and a single second nozzle 22.

Figure 2:
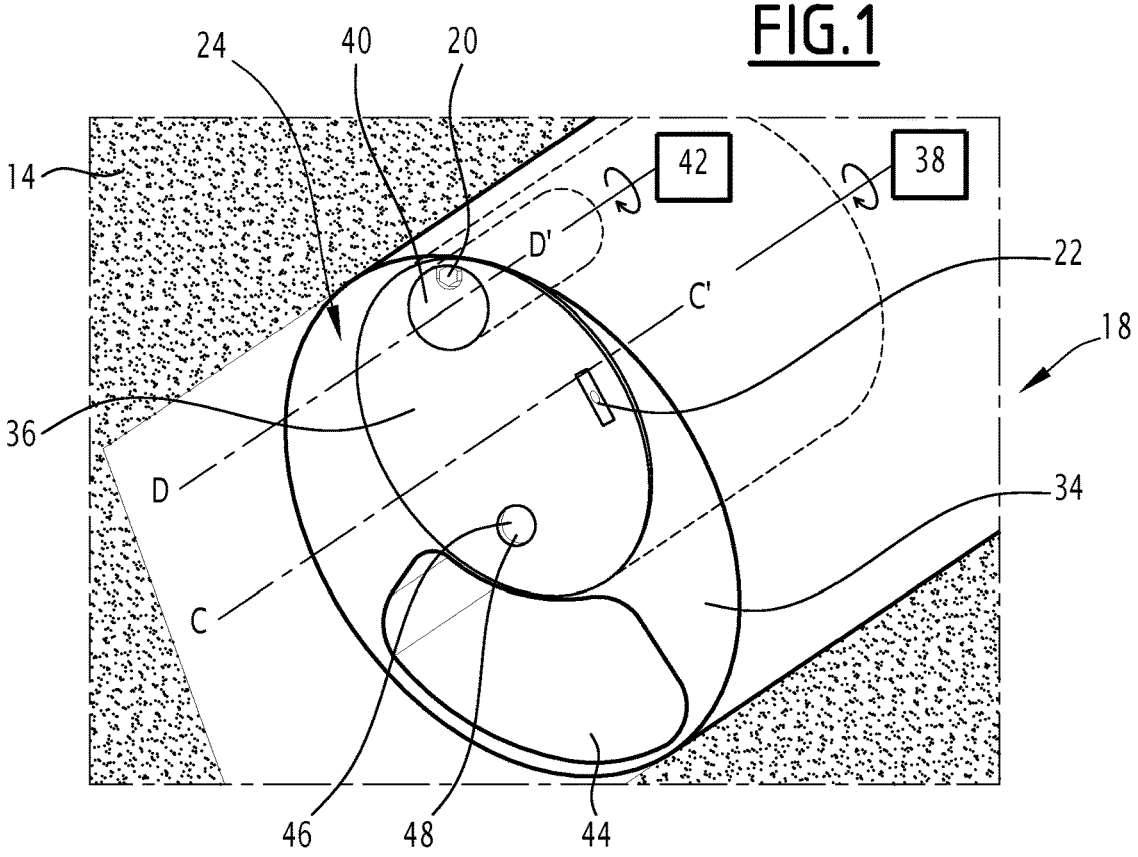
FIG. 2 is a perspective view of the boring head of the boring assembly of FIG. 1.

As visible in FIG. 2, the boring head 18 is cylindrical. The boring head 18 has a central head axis B-B' extending along the main axis A-A'.

Advantageously, the boring head 18 has a diameter greater than 200 mm. In theory, the diameter has no upper limit. For applications to civil engineering, the boring head 18 has a diameter in particular of between 200 mm and 1000 mm, for example 280 mm.

The drilling head 18 has a front face 24, the front face 24 being configured to be arranged across from the zone of the wall 12 to be bored. The front face 24 is substantially orthogonal to the central head axis B-B'.

The or each first nozzle 20 is configured to deliver a jet of fluid, in particular a jet of abrasive-free water.

An abrasive refers to a very hard material used to wear down other, softer materials. In particular, the abrasive material has a hardness greater than 6 mohs. An abrasive material is also characterized by its particle size, which is advantageously between 30 and 80 mesh.

The or each second nozzle 22 is configured to deliver a jet of fluid, in particular a jet including at least one abrasive material. The abrasive material is for example made up of garnet or almandine. Advantageously, the fluid is water in which the abrasive material is added.

The boring assembly 10 further comprises a first delivery device 26 and a second delivery device 28.

The first delivery device 26 is configured to deliver the jet of abrasive-free water to the at least one first nozzle 20.

In particular, the first delivery device 26 is configured to deliver the jet of water at a very high pressure in order to allow the boring by demolition by spalling of the concrete 14. The very high pressure of the jet of water is between 2000 bar and 3000 bar. The flow rate associated with the jet of water is between 10 $l \cdot min^{-1}$ and 20 $l \cdot min^{-1}$.

The boring assembly 10 advantageously comprises at least one third nozzle, not shown in the figures.

The first delivery device 26 is further configured to deliver a jet of abrasive-free water at low pressure to the at least one third nozzle in order to allow the discharge of the rubble from the zone of the wall 12 to be bored. In particular, the low pressure of the jet of water is between 2 bar and 10 bar. The flow rate associated with the jet of water is then between 20 $l \cdot min^{-1}$ and 100 $l \cdot min^{-1}$.

The first delivery device 26 advantageously includes a tank comprising water, a pump and a pipe from the tank to the or each first nozzle 20, not shown.

The second delivery device 28 is configured to deliver the jet including at least one abrasive material to the at least one second nozzle 22. The pressure of the abrasive jet is between 2000 and 3000 bars. The flow rate associated with the abrasive jet is then between 200 and 500 $g \cdot min^{-1}$.

The second delivery device 28 advantageously includes a tank comprising an abrasive material, a pump and a pipe from the tank to the or each second nozzle 22, not shown.

Advantageously, the boring assembly 10 further comprises a frame 30 and a first drive 32.

The frame 30 is a support located separately from the wall 12. The frame 30 is stationary relative to the wall 12.

The first drive 32 is configured to rotate the boring head 18 relative to the frame 30 around the central head axis B-B'. Advantageously, the amplitude of the rotation allowed by the first drive 26 is 360°.

The first drive 32 is of any appropriate type to allow said rotation. For example, the first drive 32 is a gear motor.

The boring assembly 10 also comprises a body 34, a first support 36 and a second drive 38.

The body 34 has a cylindrical shape, having the head axis B-B' as central axis and the same diameter as the boring head 18. The front face of the body 34 is parallel to and substantially at the same level as the front face 24 of the boring head 18.

The first support 36 is cylindrical, having a first support central axis C-C' different from the central head axis B-B'. The first support central axis C-C' is for example substantially parallel to the central head axis B-B'. In a variant, the first support central axis C-C' forms a non-nil angle, in particular between 0° and 45° with the central head axis B-B'.

Figure 4:
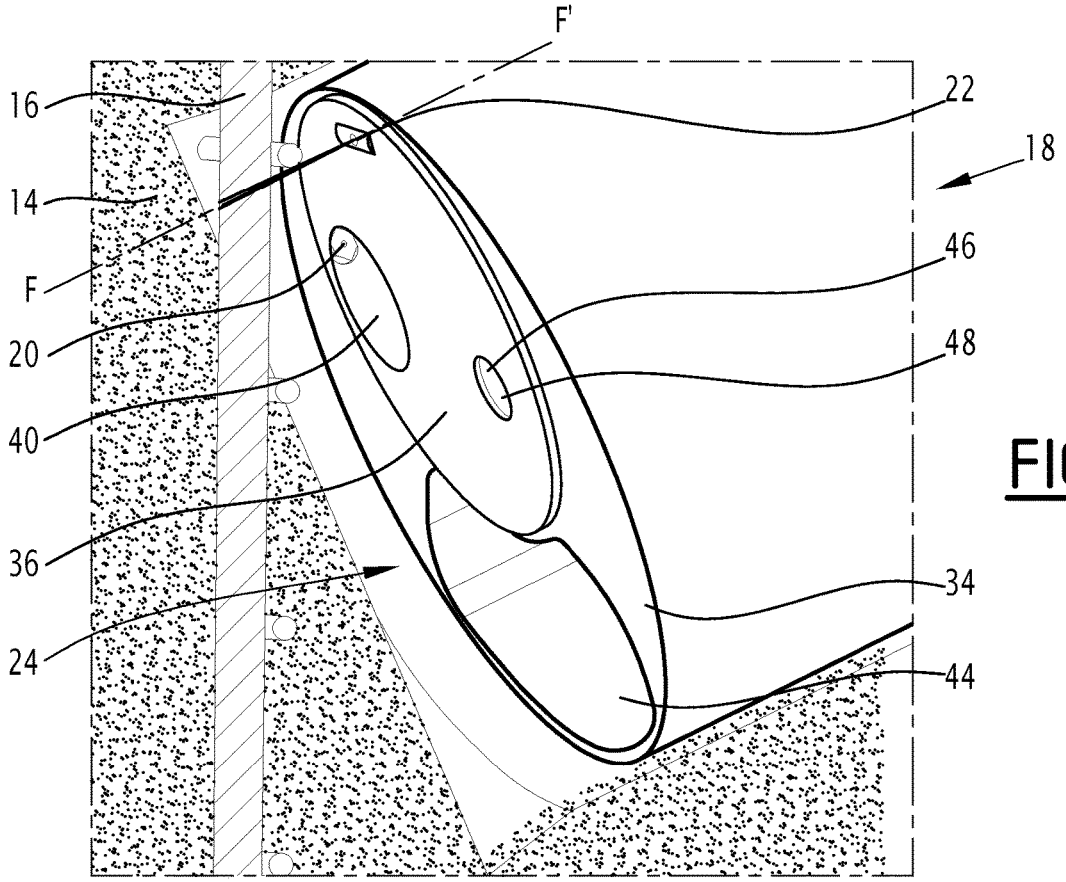
FIG. 4 is a perspective view of the boring head of the boring assembly of FIG. 1 during a step for delivering a jet of abrasive.
Figure 5:
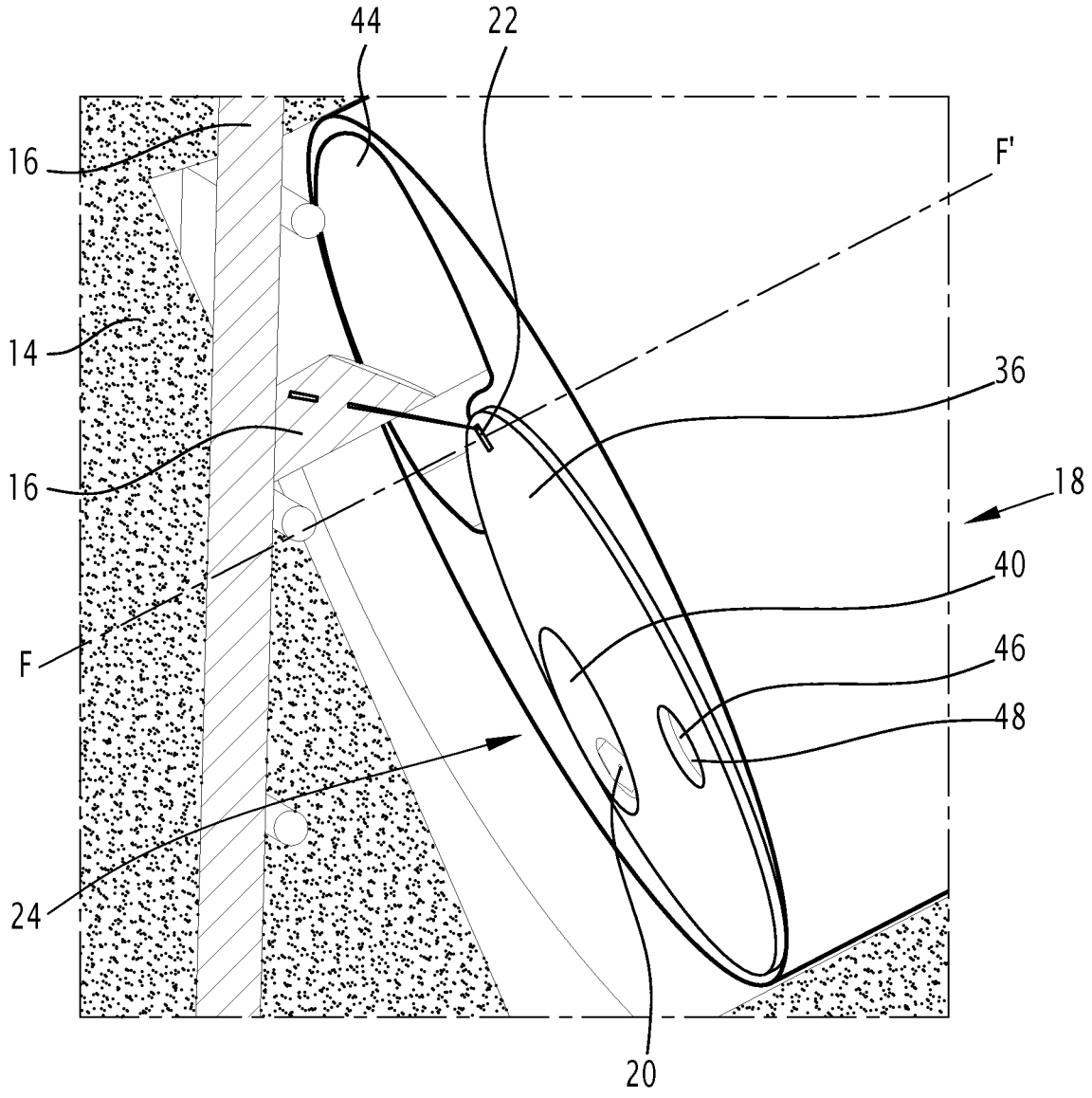
FIG. 5 is a perspective view of the boring head of the boring assembly of FIG. 1 during a step for delivering a jet of abrasive oriented differently than in FIG. 4.

As shown in FIGS. 4 and 5, the or each second nozzle 22 is configured to deliver an adjustable jet forming an angle between 0° and 80° relative to an axis F-F' passing through said second nozzle 22 and parallel to the first support axis C-C'.

As shown in FIG. 2, the first support 36 is inserted into the body 34. Advantageously, the first support 36 is connected in rotation to the body 34 around the first support central axis C-C'. The first support 36 emerges on the front face 24. The first support front face 36 is for example parallel to and substantially at the same level as the front face 24 of the boring head 18.

The or each second nozzle 22 is arranged on the first support 36 and, in particular, on the front face of the first support 36.

The second drive 38 is configured to rotate the first support 36 relative to the body 34 around the first support central axis C-C'. Advantageously, the amplitude of the rotation allowed by the second drive 28 is 180°.

The second drive 38 is of any appropriate type to allow said rotation. For example, the second drive 38 is a gear motor.

By combination between the rotation allowed by the first drive 32 and the rotation allowed by the second drive 38, the nozzles 20, 22 are able to follow any desired path on the front face 24.

In one advantageous embodiment, the boring assembly 10 further comprises a second support 40 and a third drive 42.

The second support 40 is cylindrical, having a second support central axis D-D' different from the first support central axis C-C'. The second support central axis D-D' is advantageously substantially parallel to the first support central axis C-C'. In a variant, the second support central axis D-D' forms a non-nil angle with the first support axis C-C'.

Figure 3:
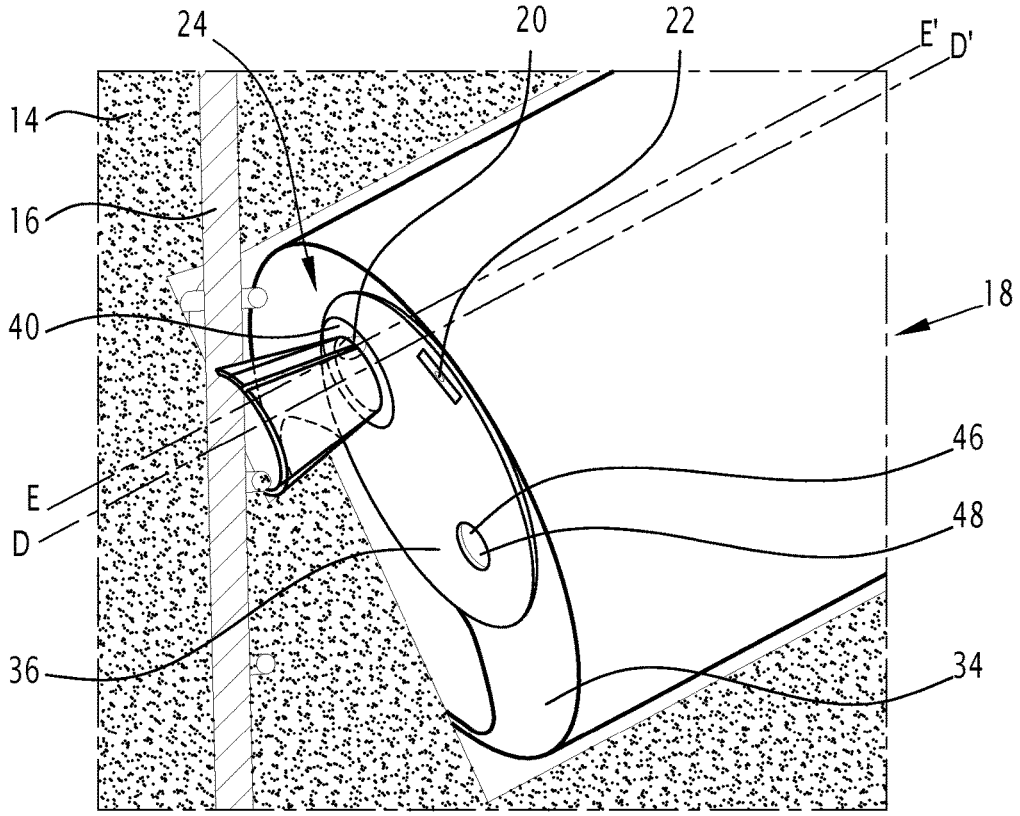
FIG. 3 is a perspective view of the boring head of the boring assembly of FIG. 1 during a step for delivering a jet of abrasive-free water.

As shown in FIG. 3, the or each first nozzle 20 is configured to deliver a jet forming an angle of between 0° and 45° relative to an axis E-E' passing through said first nozzle 20 and parallel to the second support central axis D-D'. As shown in FIG. 2, the second support 40 is inserted into the first support 36. Advantageously, the second support 40 is connected in rotation to the first support 36 around the second support central axis D-D'. The second support 40 emerges on the front face 24. The front face of the second support 40 is parallel to and substantially at the same level as the front face 24 of the boring head 18.

The or each first nozzle 20 is advantageously arranged on the second support 40. In particular, the or each first nozzle 20 is located on the front face of the second support 40.

The third drive 42 is configured to rotate the second support 40 relative to the first support 36 around the second support central axis D-D'. Advantageously, the amplitude of the rotation allowed by the third drive 42 is 360°. In particular, the third drive 42 is configured to allow a continuous rotation of the second support 40, in particular at a rotation speed of between 100 and 600 rpm.$^{-1}$, for example 500 rpm$^{-1}$.

The third drive 42 is of any appropriate type to allow said rotation. For example, the third drive 42 is a gear motor.

In a variant, the third drive 42 is configured to allow the rotation of the second support 40 using the water flow circulating through the or each first nozzle 20.

Advantageously, the boring assembly 10 comprises a suction port 44.

The suction port 44 is arranged in the body 34 and the opening of the suction port 44 emerges on the front face 24. The suction port 44 extends along the central head axis B-B'.

The suction port 44 is configured to suction, through the opening, rubble originating from the boring of the wall 12 as well as the fluids injected by the nozzles 20, 22 and to transport the rubble and the fluids from the front face 24 toward the outside of the wall 12.

The suction port 44 is advantageously connected to a pump, not shown, configured to create a vacuum causing the suction and the transport of the rubble and fluids.

The boring assembly 10 advantageously comprises a lighting device 46 and a camera 48.

The lighting device 46 is supported by the first support 36, in particular on the front face of the first support 36. The lighting device 46 is configured to illuminate the zone of the wall 12 to be bored. The lighting device 46 is advantageously made up of a plurality of bulbs arranged evenly in a circle around the camera 48.

The camera 48 is supported by the first support 36, in particular on the front face of the first support 36. The camera 48 is configured to record and transmit to a screen, not shown and located outside the wall 12, photographs or videos of the zone of the wall 12 to be bored. Advantageously, the camera 48 is configured to instantaneously transmit the acquired images to the screen in order to allow between control of the boring.

Advantageously, the lighting device 46 and the camera 48 are configured to go from a hidden configuration in which the lighting device 46 and the camera 48 are protected during the boring, to an active configuration in which the lighting device 46 and the camera 48 are able to illuminate and film the zone of the wall 12 to be bored.

Advantageously, the boring assembly 10 comprises at least one fourth nozzle, not shown in the figures, configured to supply a jet of compressed air on the lighting device 46 and the camera 48 in order to clean them and/or protect them from drippings during viewing steps after the boring steps.

The boring assembly 10 also comprises a fourth drive 50.

The fourth drive 50 is configured to translate the boring head 18 along the central head axis B-B' relative to the frame 30 and thus to make it possible to advance the boring of the wall 12 as the reinforced concrete is bored.

The fourth drive 50 is of any appropriate type to allow said translation. For example, the fourth drive 50 is a screw-nut system or a rack.

A boring method using the boring assembly 10 will now be described.

Initially, the boring assembly 10 is separated from the wall 12.

The front face 24 of the boring head 18 is placed facing the wall 12 using the fourth drive 50, which moves the boring head 18 in translation along the central head axis B-B' relative to the frame 30.

The first drive 32 and the second drive 38 place the boring head 18 and the first support 36 in the desired position facing the zone of the wall 12 to be bored.

If the zone of the wall 12 to be bored is made from concrete 14, the boring method then comprises a step for first delivery by the first delivery device 26 of a jet of abrasive-free water at very high pressure to the or each first nozzle 20. The concrete body 14 is then demolished by the very high-pressure jet of abrasive-free water, as shown in FIG. 3. Advantageously, a thickness of concrete 14 of between 40 mm and 60 mm is demolished during the first delivery step.

In particular, the third drive 42 rotates the or each first nozzle 20 around the second support central axis D-D' relative to the first support 36. The described jet of abrasive-free water then describes a cone around the second support central axis D-D', as shown in FIG. 3, thus allowing an easier demolition of a thickness of concrete 14.

By combination between the rotation done by the first drive 32 and the rotation done by the second drive 38, the or each first nozzle 20 describes the desired path and makes it possible to remove a layer of the wall 12 made from concrete 14 along the diameter of the boring.

Additionally, the fourth drive 50 translates the boring head 18 by levels as the zone made from concrete 14 of the wall 12 is demolished.

Between each demolition level of the concrete 14, the lighting device 46 and the camera 48 go from the hidden configuration to the active configuration. The lighting device 46 illuminates the zone to be bored and the camera 48 films and transmits the images of the zone of the wall 12 to be bored in order to control the boring and identify the metallic elements 16 that may be removed, in particular the steel or iron bars.

When the front face 24 is across from a metallic element 16, the step for first delivery of the very high-pressure jet of abrasive-free water stops.

When the concrete zone 14 to be bored has been demolished, the first delivery device 26 delivers a low-pressure jet of abrasive-free water to the or each third nozzle in order to remove the rubble present across from the front face 24. The suction port 44 suctions the water injected by the jet and the rubble and transports them outside the wall 12.

The lighting device 46 and the camera 48 make it possible to identify the position and the shape of the metallic element 16.

The first drive 32 and the second drive 38 place the boring head 18 and the first support 36 in the desired position facing the metallic element 16 to be destroyed.

The boring method then comprises a step for second delivery by the second delivery device 28 of a jet including at least one abrasive material to the or each second nozzle 22.

The metallic element 16 is then cut by the abrasive jet, as shown in FIGS. 4 and 5.

The or each second nozzle 22 orients the abrasive jet as a function of the shape and the orientation of the metallic element 16.

In particular, the or each second nozzle 22 makes it possible to cut a metallic element 16 oriented in substantially the same direction as the front face 24, as shown in FIG. 4.

The or each second nozzle 22 also makes it possible to cut a metallic element 16 oriented substantially along the central head axis B-B', as shown in FIG. 5, with a different orientation of the abrasive jet.

By combination between the rotation done by the first drive 32 and the rotation done by the second drive 38, the or each second nozzle 22 describes the desired path and makes it possible to destroy the metallic element 16 precisely.

When the metallic element 16 has been demolished, the first delivery device 26 delivers a low-pressure jet of abrasive-free water to the or each third nozzle in order to remove the rubble present across from the front face 24. The suction port 44 suctions the water injected by the jet and the pieces of iron and transports them outside the wall 12.

In a variant, the suctioning is done during the demolition steps of the wall 12, in order to remove the concrete rubble 14 and the cut metallic elements 16 continuously.

The terms "first delivery" and "second delivery" are used as simple terminology, but do not imply any relationship of temporal correlation between the steps of the boring method. The first delivery can thus be done before, during or after the second delivery.

Similarly to what has been described above, the boring method subsequently alternatively comprises first delivery steps to demolish the concrete zones 14 of the wall 12 and second delivery steps to destroy the metallic elements 16 present in the wall 12.

The boring method therefore allows boring in a reinforced concrete wall 12 not requiring the alternating introduction of several boring heads and thus allowing easier handling of the boring assembly 10. In addition to the time savings allowed by keeping the machine in place, the absence of round-trip is favorable to the reduced dispersion of rubble and effluents, which is a major point when working in a contaminated environment.

Additionally, the different drives 32, 38, 42, 50 and the orientation of the jets at the outlet of the nozzles 20, 22 make it possible to split the different elements 14 of the wall 12 into small enough residual rubble to be removed and transported by the suction port 44 using the stream of water injected by the or each third nozzle. In particular, the hydrodemolition allowed by the or each first nozzle 20 and the first delivery device 26 makes it possible to split the concrete 14 into pieces, the size of which is given by the mineral elements, such as stones, included in the composition of the concrete 14. The precise cutting of the metal elements 16 using the controlled path of the or each second nozzle 22 makes it possible to split the metallic elements 16, such as steel or iron bars, into small segments that are easily transportable by the suction port 44.

The boring assembly 10 also makes it possible to perform an inclined boring without damaging the equipment items located near the wall 12.

Inclined boring refers to boring done in a direction forming a non-nil angle with the axis normal to the outlet face, in particular an angle greater than 20° as shown in FIG. 1. The inclined boring is in particular advantageously done in a direction going from top to bottom.

Indeed, the metallic elements 16 are usually found in a civil engineering structure at least 50 mm inside the wall 12. The alternating use of the nozzles 20, 22 and abrasive cutting being able to be done in a targeted manner on the metallic sections, the end of the borehole may emerge outside the wall 12 without using the abrasive cutting jet. The use of the abrasive-free jet alone makes it possible not to cut any metallic elements beyond the borehole, and in particular to bore any metallic wall to be preserved.

Additionally, the alternating use of the two delivery devices 22, 24 makes it possible to optimize the quantity of abrasives used, which makes it possible to reduce costs, as well as the ecological impact of the boring.

Lastly, the boring assembly 10 makes it possible to reduce the reaction forces of the jets, typically less than 10 daN, which lightens the structure and the necessary weight of the boring assembly 10, unlike boring done with a pneumatic drill, for example, which leads to cracks in the structure.

The boring assembly 10 is in particular advantageously used to dismantle nuclear power plants having experienced accidents such as the Fukushima plant, for example.

The boring assembly 10 is also used to form openings in civil engineering structures when it is important to preserve the reinforcement bordering the opening so as to be able to subsequently remesh the structure when there is a new need.

The invention claimed is:

1. A boring assembly extending along a main axis and comprising:

a boring head including:

at least one first nozzle;

at least one second nozzle, the at least one second nozzle being different from the at least one first nozzle;

a first delivery device configured to deliver a jet of abrasive-free water at a pressure of between 2000 bar and 4000 bar to the at least one first nozzle; and a second delivery device configured to deliver a jet containing at least one abrasive material at a pressure of between 2000 bar and 6000 bar to the at least one second nozzle, wherein the boring head has a front face substantially orthogonal to the main axis, the first nozzle and the second nozzle emerging on the front face, the jet of abrasive-free water flowing out of the first nozzle at the front face, the jet containing at least one abrasive material flowing out of the second nozzle at the front face.

2. The boring assembly according to claim 1, wherein the boring head is cylindrical, the boring head having a central head axis extending along the main axis.

3. The boring assembly according to claim 2, wherein the boring head has a diameter of between 200 mm and 1000 mm.

4. The boring assembly according to claim 2, further comprising:

a frame, and a first rotational drive configured for driving the boring head relative to the frame around the central head axis.

5. The boring assembly according to claim 4, further comprising:

a body;

a first cylindrical support having a first support central axis different from the central head axis; and a second rotational drive configured for driving the first cylindrical support relative to the body around the first support central axis, the at least one second nozzle being arranged on the first cylindrical support, and the first cylindrical support being connected to the body in rotation around the first support central axis.

6. The boring assembly according to claim 5, further comprising:

a second cylindrical support having a second support central axis different from the first support central axis, and a third rotational drive configured for driving the second cylindrical support relative to the first cylindrical support around the second support central axis, the at least one first nozzle being arranged on the second cylindrical support, and the second cylindrical support being connected to the first cylindrical support in rotation around the second support central axis.

7. The boring assembly according to claim 6, further comprising a fourth drive of the boring head in translation along the main axis relative to the frame.

8. The boring assembly according to claim 5, further comprising a rubble suction port.

9. The boring assembly according to claim 8, wherein the rubble suction port is arranged in the body and extends along the main axis.

10. The boring assembly according to claim 5, wherein the boring head comprises a lighting device and a camera.

11. The boring assembly according to claim 10, wherein the lighting device and the camera are supported by the first support.

12. The boring assembly according to claim 1, wherein the at least one second nozzle is configured to deliver an adjustable jet forming an angle between 0° and 45° relative to an axis passing through the second nozzle and parallel to the main axis.

13. A boring method using the boring assembly according to claim 1, comprising the following steps:

first delivering, by the first delivery device, the jet of abrasive-free water at the pressure of between 2000 bar and 4000 bar to the at least one first nozzle;

second delivering, by the second delivery device, a jet containing the at least one abrasive material at the pressure of between 2000 bar and 6000 bar to the at least one second nozzle;

the first delivering having taken place before, during and/or after the second delivering.

14. The boring method according to claim 13, further comprising:

demolishing a concrete body by the jet of abrasive-free water delivered during the first delivering; and cutting a metallic element by the jet including at least one abrasive material delivered during the second delivering.

15. A boring assembly extending along a main axis and comprising:

a boring head including:

at least one first nozzle;

at least one second nozzle, the at least one second nozzle being different from the at least one first nozzle;

a first delivery device configured to deliver a jet of abrasive-free water at a pressure of between 2000 bar and 4000 bar to the at least one first nozzle; and a second delivery device configured to deliver a jet containing at least one abrasive material at a pressure of between 2000 bar and 6000 bar to the at least one second nozzle, the first delivery device and the second delivery device being configured separate from each other such that the jet of abrasive-free water is separate from the jet containing at least one abrasive material.

16. The boring assembly according to claim 15, wherein the boring head has a front face substantially orthogonal to the main axis, the first nozzle and the second nozzle emerging on the front face.

17. A boring assembly extending along a main axis and comprising:

a boring head including:

a first nozzle;

a second nozzle, the second nozzle being different from the first nozzle;

a first delivery device configured to deliver a first jet of abrasive-free water at a pressure of between 2000 bar and 4000 bar to the first nozzle; and a second delivery device configured to deliver a second jet containing at least one abrasive material at a pressure of between 2000 bar and 6000 bar to the second nozzle, wherein the boring head has a front face defining an exterior of the boring head, the first nozzle emerging on the front face to deliver the first jet through the front face, the second nozzle emerging on the front face to deliver the second jet through the front face spaced apart from the first jet.

* * * * *